United States Patent [19]

Emery et al.

[11] Patent Number: 5,066,516

[45] Date of Patent: Nov. 19, 1991

[54] ELECTRICAL CABLE MANUFACTURE

[75] Inventors: Kenneth R. Emery, Winchester; Harold R. Bennett, Chilbolton; Jack Clark, Chandlers Ford, all of England

[73] Assignee: Pirelli General plc, London, England

[21] Appl. No.: 324,387

[22] Filed: Mar. 16, 1989

[30] Foreign Application Priority Data

Mar. 23, 1988 [GB] United Kingdom ..... 8806939
Jan. 31, 1989 [GB] United Kingdom ..... 8902074

[51] Int. Cl.[5] ..... C23C 26/00
[52] U.S. Cl. ..... 427/118; 427/117
[58] Field of Search ..... 427/118, 117

[56] References Cited

U.S. PATENT DOCUMENTS

| | | | |
|---|---|---|---|
| 3,953,310 | 4/1976 | Hiraoka | 427/118 |
| 4,252,842 | 2/1981 | Jung | 427/118 |
| 4,370,517 | 1/1983 | Soma | 174/110 PM |
| 4,391,848 | 7/1983 | Hilker | 427/118 |
| 4,458,105 | 7/1984 | Roenisch | 29/241 |
| 4,652,323 | 3/1987 | Butt | 427/118 |
| 4,877,467 | 10/1989 | Marsden | 427/118 |

FOREIGN PATENT DOCUMENTS

| | | | |
|---|---|---|---|
| 57604 | 8/1982 | European Pat. Off. | 427/118 |
| 2337462 | 2/1975 | Fed. Rep. of Germany | 427/118 |
| 2215903 | 9/1989 | United Kingdom | 427/118 |

*Primary Examiner*—Shrive Beck
*Assistant Examiner*—Vi D. Dang
*Attorney, Agent, or Firm*—Brooks Haidt Haffner & Delahunty

[57] ABSTRACT

A polyol-water mixture is applied over the polymeric insulation of the or each conductor core of an electrical cable prior to extruding the polymeric sheath of the cable thereover such that the polymeric sheath is prevented from adhering to the polymeric insulation.

16 Claims, 2 Drawing Sheets

ELECTRICAL CABLE MANUFACTURE

Figure 1:
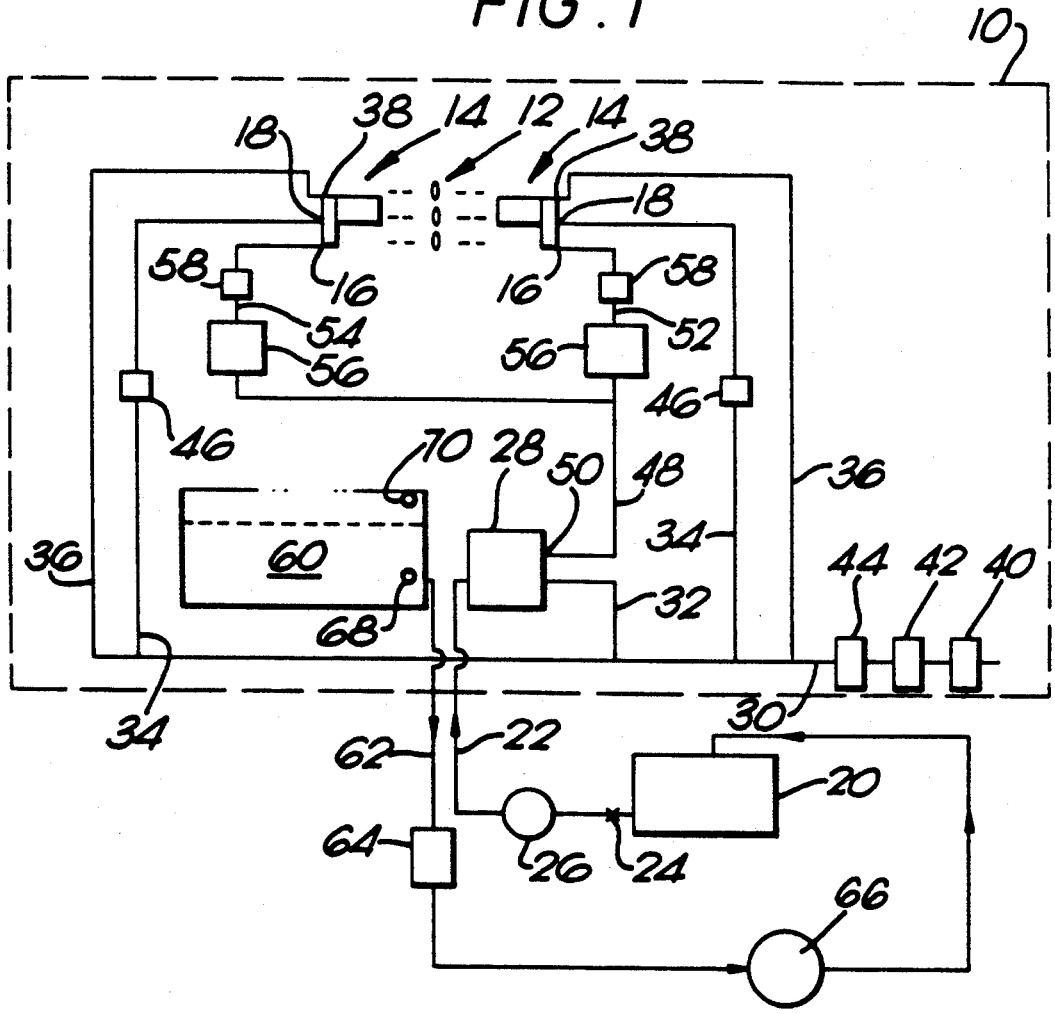

This invention relates to electrical cable manufacture, and more particularly is concerned with a method of manufacturing an electrical cable comprising a polymeric sheath extruded over at least one conductor core provided with polymeric insulation.

When a polymeric sheath is extruded over a conductor core provided with polymeric insulation the material of the sheath is prone to adhere to the material of the insulation, thus making consequent stripping of the sheath from the insulation difficult.

Examples of electrical cables comprising a polymeric sheath extruded over conductor cores provided with polymeric insulation include flat twin core cable utilised in house wiring and appliance leads which may comprise two or three cores.

As will be appreciated, it is desirable for the sheath to be readily strippable from the insulated cores without damaging the insulation in order for connections to be made. Conventionally, the insulated cores have been dusted with talc or chalk prior to the extruded sheath being applied over them in order to prevent the sheath adhering to the insulation. However, the use of talc or chalk in this manner gives rise to dust and health hazards. Furthermore, typically the talc or chalk is applied to the insulation by the insulated cores being passed through a bed of the talc or chalk and this has been found to be unreliable since furrowing may occur in the bed so that the whole of the outer periphery of the insulated core does not become covered with the talc or chalk, and blockages in the supply of chalk or talc to the bed also occur. Furthermore, the above-mentioned known operation is not susceptible to use at high throughput speeds, nor is it adaptable for automation.

According to the present invention there is provided a method of manufacturing an electrical cable comprising a polymeric sheath extruded over at least one conductor core provided with polymeric insulation, said method including applying a polyol-water mixture over the polymeric insulation of the or each conductor core prior to extruding the polymeric sheath thereover such that the polymeric sheath is prevented from adhering to the polymeric insulation.

The invention includes an electrical cable comprising a polymeric sheath extruded over at least one conductor core provided with polymeric material when made by a method as defined in the last preceding paragraph.

The invention also includes apparatus for use in a method as defined in the last but one preceding paragraph and comprising at least one spray unit, the or each spray unit having a through-passage for at least one conductor covered with polymeric insulation and provided with spray means arranged for spraying a polyol-water mixture onto the polymeric insulation of the or each conductor during its passage through the spray unit.

Thus, in the preferred method the polyol-water mixture is sprayed onto the polymeric insulation.

The mixture may comprise from two to six, or preferably three to five parts polyol to one part water by volume. In a preferred embodiment the mixture comprises substantially four parts polyol to one part water by volume.

A surfactant may be added to the polyol-water mixture prior to the mixture being sprayed onto the polymeric insulation, in which case the mixture may comprise from a half to three parts polyol to one part water by volume, and preferably about one part polyol to one part water. The volume of added surfactant may be about 1-2% of the volume of the polyol-water mixture and a suitable surfactant comprises a block copolymer of ethylene oxide and propylene oxide.

The method may include utilising compressed air to atomise the mixture being sprayed onto the polymeric insulation.

The method may comprise supplying water and polyol from separate supplies thereof to a container, supplying the resulting mixture from said container to at least one spray unit for spraying the mixture onto the polymeric insulation of at least one conductor core, monitoring the supply of mixture from the container to provide an indication of the volume ratio of polyol to water thereof, and adjusting at least one of the supplies of polyol and water to the container to maintain said indication within two predetermined limits.

The viscosity or the density of the supply of mixture from the container may be monitored to provide the above-mentioned indication.

The method preferably includes collecting the residual sprayed mixture at the or each spray unit and returning this collected residual sprayed mixture to the container.

The polyol used in the method may comprise glycerol, polyethylene glycol, or polypropylene glycol.

The spray means of the or each spray unit of the apparatus may comprise at least two spray nozzles directed towards the through-passage thereof for spraying said mixture over the entire outer surface of the insulation of the or each conductor as it passes through said through-passage. Each of said spray nozzles may have an inlet for said mixture and an inlet for compressed air and is arranged to produce an atomised spray of said mixture.

The apparatus advantageously comprises a container for containing a quantity of said mixture, separate means for supplying said container with water and polyol, means for supplying the mixture of water and polyol from the container to the or each spray unit, means for monitoring the supply of mixture from the container to provide a signal indicative of the volume ratio of polyol to water thereof, and means responsive to said signal for adjusting at least one of said supplies of polyol and water to the container to maintain said volume ratio within predetermined limits. The monitoring means may comprise means responsive to the viscosity or the density of the mixture.

Furthermore, the or each spray unit of the apparatus advantageously comprises means for collecting residual sprayed mixture, and the apparatus further comprises means for returning the residual sprayed mixture collected in the collecting means to the container.

Figure 2:
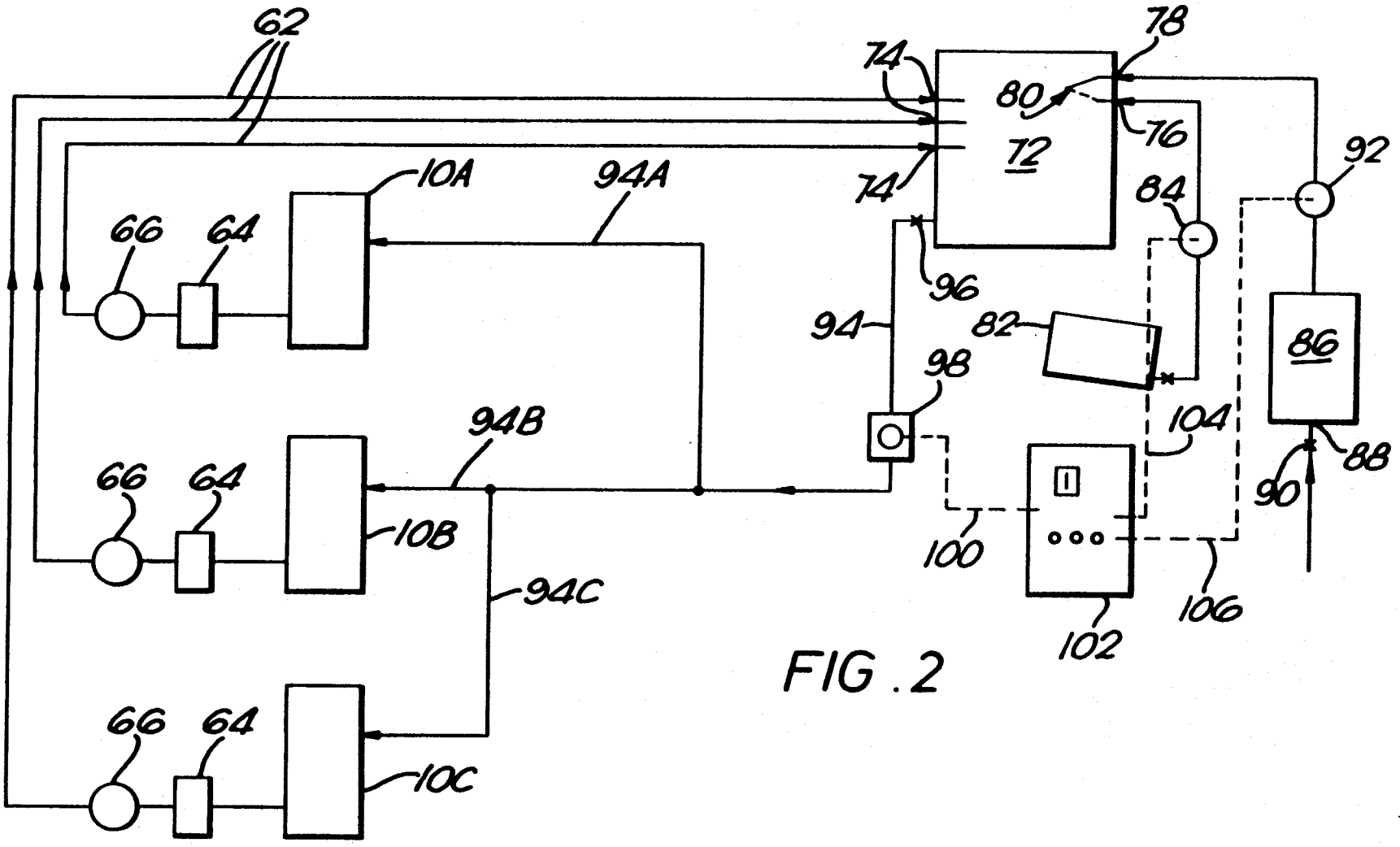

In order that the invention may be well understood, two embodiments thereof, which are given by way of example only, will now be described with reference to the accompanying drawings, in which:

FIG. 1 is a schematic illustration of apparatus for spraying a polyol-water mixture over the polymeric insulation of at least one conductor core; and FIG. 2 is a schematic illustration of similar apparatus for spraying a polyol-water mixture over the polymeric insulation of at least three conductor cores.

Referring first to FIG. 1, the apparatus illustrated comprises a spray unit 10 having a through-passage 12 for at least one conductor covered with polymeric insulation. The through-passage extends normally to the plane of FIG. 1 and the spray unit is provided with spray means arranged for spraying a polyol-water mixture onto the polymeric insulation of the or each conductor during its passage through the spray unit. As illustrated, the spray means comprise two spray nozzles 14 directed towards the through-passage for spraying the mixture over the entire outer surface of the insulation of the or each conductor as it passes through the through-passage 12. It will however be appreciated that more than two such spray nozzles may be provided.

Each spray nozzle has an inlet 16 for the mixture of polyol-water and an inlet 18 for compressed air and is arranged to produce an atomised spray of the mixture.

The apparatus includes a container 20 for containing a quantity of the polyol-water mixture. A conduit 22 connects the container 20 via a control valve 24 and monitoring unit 26 to a pump 28 of the spray unit. The pump 28 is pneumatically operated and connected to a compressed air supply by conduits 30 and 32. The conduit 30 also supplies compressed air to further conduits 34 and 36 which are connected to each spray nozzle 14, the conduit 34 being connected to the compressed air inlet 18 and the conduit 36 being connected to an inlet 38 of a pneumatically operated valve arrangement of each nozzle. In the conduit 30 upstream of the conduits 32, 34 and 36 there is provided in line a pressure limiting switch 40, a solenoid operated valve 42 and a filter 44. The pressure limiting switch is set to limit the air pressure to a predetermined value, for example 80 psi. A spray control valve 46 is provided in the conduit 34 to enable the amount of air being supplied to each nozzle to be controlled. For example this spray control valve may have four operating conditions and is switchable between those conditions to provide four different spray patterns from the nozzle 14.

A conduit 48 is connected to the outlet 50 of the pump 28 and via two branches 52 and 54 to the respective mixture inlets 16 of the two nozzles. Each branch 52 and 54 includes a filter 56 and a flow sensor 58.

The spray unit 10 also includes a collection tank 60 disposed in the unit to collect residual sprayed mixture, i.e. mixture which has been sprayed by the nozzles but does not leave the spray unit on the polymeric insulation. This residual mixture is redirected via conduit 62, filter 64 and pump 66 to the mixture container 20. The collection tank 60 is provided with respective low and high level limit switches 68 and 70. These limit switches control operation of the pump 66 and can also be utilised to provide alarm signals. Thus, a signal from the low level limit switch 68 can be arranged to provide an alarm indicating that the quantity of mixture in the apparatus has fallen below a predetermined level and that further mixture has to be added to the collection tank. An alarm signal from the high level limit can be used to indicate that the amount of further mixture added has brought the quantity in the system to a predetermined maximum amount.

In order to operate the above described apparatus, the solenoid valve 42 is actuated to supply compressed air to the pump 28 to drive the same, to the pneumatically controlled valve of each nozzle 12 to actuate those nozzles and to the air inlets 18 of the nozzles. The pump 28 pumps mixture from the container 20 to the two nozzles 14 where the mixture is atomised by the compressed air and sprayed onto the insulation of a conductor core passing through the through-passage 12 of the spray unit. Residual sprayed mixture is collected in the collection tank and returned by pump 66 to the container 20.

The monitoring unit 26 monitors the supply of mixture from the container 20 to provide an indication of the volume ratio of the polyol to water of the mixture. The monitoring unit may for example monitor the viscosity of the supply of mixture or alternatively the density of this supply to provide an indication of its volume ratio. The volume ratio of polyol to water in the system illustrated in FIG. 1 can be adjusted by adding either polyol or water to the collection tank 60.

Referring now to FIG. 2, there is illustrated an alternative apparatus which comprises more than one spray unit, wherein all of the spray units are provided with a common supply of polyol-water mixture. In the apparatus illustrated, three such spray units are provided and are indicated by the reference numerals 10A, 10B and 10C. Each of these units is identical in construction to the spray unit 10 of the apparatus illustrated in FIG. 1. Furthermore, each unit is provided with a conduit 62 from the collection tank thereof for returning residual mixture via a filter 64 and pump 66 to a mixture container. However, in this case the container is common to the three spray units. This common container is referenced 72 and in addition to being provided with three inlets 74 for residual mixture from the spray units has separate inlets 76 and 78 for polyol and water. These inlets may be connected to a mixing jet or other mixing means diagrammatically illustrated at 80 to ensure that the polyol and water is thoroughly mixed as it enters the container. The polyol inlet 76 is connected to a supply of polyol, schematically illustrated as a drum 82 containing polyol, via a dosing pump 84. The water inlet 78 is connected to a demineralised water unit 86 which is arranged to be supplied with mains water through an inlet 88 and control valve 90, a dosing pump 92 being provided to control the supply of demineralised water from the unit 86 to the water inlet 78 of the container 72.

The mixture of polyol and water in the container 72 is supplied via a common conduit 94 and thereafter branch conduits 94A, 94B and 94C to the individual spray units. The common conduit 94 is provided with a stop valve 96 and also incorporates a monitoring unit 98 corresponding to the monitoring unit 26 provided in the apparatus illustrated in FIG. 1. The monitoring unit 98 is connected via a signal transmitting line 100 to a control unit 102 to provide a signal to that unit indicative of the volume ratio of polyol to water thereof. The signal is used to control actuation of the dosing pumps 84 and 92, which are connected to the control unit 102 by respective power lines 104 and 106, to maintain the volume ratio within predetermined limits. It will be appreciated that the apparatus illustrated in FIG. 2, which provides automatic maintenance of the polyol to water volume ratio may incorporate only one spray unit although it is particularly advantageous to incorporate more than one spray unit in the apparatus.

It is also to be understood that each respective spray unit may be used to spray a single insulated conductor core passing through it or alternatively more than one insulated conductor core. Furthermore, it is to be understood that the sprayed conductor cores from the spray units may be fed into a common extruder for extruding polymeric insulation over those conductor cores, or into respective extruders such that the sprayed core or cores from each unit is fed into a different extruder.

Tests have established that by maintaining the volume ratio of the mixture between two and six parts polyol to one part water satisfactory results are obtained. It is believed that the polymeric sheath being extruded over the polymeric insulation is prevented from adhering to the polymeric insulation because the water of the mixture vaporises thus temporarily separating the sheath from the conductor core insulation as it is extruded over the conductor insulation, the polyol acting to prevent adhesion between the sheath and core insulation subsequently.

It has been found that if the mixture contains too much water, blistering of the sheath occurs whereas if there is too little water, the sheath adheres to the core insulation. Best results have occurred with a volume ratio of from three to five parts polyol to one part water and accordingly if the mixture can be maintained at substantially four parts polyol to one part water by volume reliable results are assured.

It has also been found that the amount of polyol in the polyol-water mixture may be reduced if a surfactant is added to the mixture. Thus, for example, with a surfactant added to the mixture the mixture may comprise from a half to three parts polyol to one part water by volume. Tests have established that a mixture comprising about one part polyol to one part water by volume produces good results when a surfactant is added to the mixture. The surfactant should have low electrical conductivity and a suitable surfactant is a block copolymer of ethylene oxide and propylene oxide, such as that marketed under the trade name, SYNPERONIC/-PEL62 by ICI. The volume of the surfactant added to the mixture may comprise about 1–2% of the volume of the polyol-water mixture.

Examples of polyols which may be used in the method are polyethylene glycol, polypropylene glycol and glycerol.

We claim:

1. A method of manufacturing an electrical cable comprising a polymeric sheath extruded over at least one conductor core provided with polymeric insulation, said method including applying a polyol-water mixture over the polymeric insulation of the or each conductor core prior to extruding the polymeric sheath thereover such that the polymeric sheath is prevented from adhering to the polymeric insulation.

2. A method as claimed in claim 1, wherein said polyol-water mixture is sprayed onto the polymeric insulation.

3. A method as claimed in claim 2, wherein said mixture comprises from two to six parts polyol to one part water by volume.

4. A method as claimed in claim 3, wherein said mixture comprises from three to five parts polyol to one part water by volume.

5. A method as claimed in claim 4, wherein said mixture comprises substantially four parts polyol to one part water by volume.

6. A method as claimed in claim 2, wherein a surfactant is added to the polyol-water mixture prior to the mixture being sprayed onto the polymeric insulation.

7. A method as claimed in claim 6, wherein the mixture comprises from a half to three parts polyol to one part water by volume.

8. A method as claimed in claim 7, wherein the mixture comprises about one part polyol to one part water by volume.

9. A method as claimed in claim 6, wherein the volume of added surfactant comprises about 1–2% of the volume of the polyol-water mixture.

10. A method as claimed in claim 6, wherein the surfactant comprises a block copolymer of ethylene oxide and propylene oxide.

11. A method as claimed in claim including utilizing compressed air to atomize said mixture being sprayed onto said polymeric insulation.

12. A method as claimed in claim 1, comprising supplying water and polyol from separate supplies thereof to a container, supplying the resulting mixture from said container to at least one spray unit for spraying the mixture onto the polymeric insulation of at least one conductor core, monitoring the supply of mixture from the container to provide an indication of the volume ratio of polyol to water thereof, and adjusting at least one of the supplies of polyol and water to the container to maintain said indication within two predetermined limits.

13. A method as claimed in claim 12, wherein the viscosity of the supply of mixture from the container is monitored to provide said indication.

14. A method as claimed in claim 12, wherein the density of the supply of mixture from the container is monitored to provide said indication.

15. A method as claimed in claim 12, including collecting residual sprayed mixture at the or each spray unit and returning the collected residual sprayed mixture to said container.

16. A method as claimed in claim 1, wherein said polyol comprises glycerol, polyethylene glycol or polypropylene glycol.

* * * * *

UNITED STATES PATENT AND TRADEMARK OFFICE

CERTIFICATE OF CORRECTION

PATENT NO. : 5,066,516

DATED : November 19, 1991

INVENTOR(S) : Emery et al

It is certified that error appears in the above-identified patent and that said Letters Patent is hereby corrected as shown below:

Col. 6, line 25, insert --2-- after "claim".

Signed and Sealed this

Twenty-third Day of March, 1993

*Attest:*

STEPHEN G. KUNIN

*Attesting Officer*

*Acting Commissioner of Patents and Trademarks*